US009540587B2

(12) United States Patent
Nakao et al.

(10) Patent No.: US 9,540,587 B2
(45) Date of Patent: Jan. 10, 2017

(54) LUBRICATING OIL COMPOSITION FOR TRANSMISSIONS

(71) Applicants: JX Nippon Oil & Energy Corporation, Tokyo (JP); AISIN AW CO., LTD., Aichi (JP)

(72) Inventors: Hajime Nakao, Tokyo (JP); Hitoshi Komatsubara, Tokyo (JP); Kazunori Ishikawa, Aichi (JP); Katsuhito Yamada, Aichi (JP)

(73) Assignees: JX Nippon Oil & Enery Corporation, Tokyo (JP); AISIN AW CO., LTD., Anjo-shi, Aichi (JP)

( * ) Notice: Subject to any disclaimer, the term of this patent is extended or adjusted under 35 U.S.C. 154(b) by 0 days.

(21) Appl. No.: 14/768,602

(22) PCT Filed: Nov. 19, 2013

(86) PCT No.: PCT/JP2013/081112

§ 371 (c)(1),
(2) Date: Aug. 18, 2015

(87) PCT Pub. No.: WO2014/129032

PCT Pub. Date: Aug. 28, 2014

(65) Prior Publication Data

US 2015/0376544 A1 Dec. 31, 2015

(30) Foreign Application Priority Data

Feb. 19, 2013 (JP) ..... 2013-029695

(51) Int. Cl.
*C10M 169/00* (2006.01)
*C10M 169/04* (2006.01)

(52) U.S. Cl.
CPC .... *C10M 169/04* (2013.01); *C10M 2203/1006* (2013.01); *C10M 2203/1025* (2013.01); *C10M 2207/026* (2013.01); *C10M 2207/2805* (2013.01); *C10M 2207/2815* (2013.01); *C10M 2207/2835* (2013.01); *C10M 2215/064* (2013.01); *C10M 2215/28* (2013.01); *C10M 2219/046* (2013.01); *C10M 2219/08* (2013.01); *C10M 2219/106* (2013.01); *C10M 2223/049* (2013.01); *C10N 2220/022* (2013.01); *C10N 2230/02* (2013.01); *C10N 2230/08* (2013.01); *C10N 2230/42* (2013.01); *C10N 2230/54* (2013.01); *C10N 2240/10* (2013.01); *C10N 2240/103* (2013.01); *C10N 2260/14* (2013.01)

(58) Field of Classification Search
CPC ..... C10M 169/04; C10M 2203/1006; C10M 2203/1025; C10M 2207/2805;C10M 2219/08; C10M 2219/106; C10M 2223/049; C10M 2207/026; C10M 2207/2815; C10M 2207/2835; C10M 2215/064; C10M 2215/28; C10M 2219/046; C10N 2220/022; C10N 2230/02; C10N 2230/08; C10N 2230/42; C10N 2230/54; C10N 2240/10; C10N 2240/103; C10N 2260/14
See application file for complete search history.

(56) References Cited

U.S. PATENT DOCUMENTS

| | | | | |
|---|---|---|---|---|
| 2006/0135378 | A1 | 6/2006 | Takahashi et al. | |
| 2011/0034358 | A1 | 2/2011 | Komatsubara | |
| 2011/0230685 | A1* | 9/2011 | Tagawa | C10G 45/58 585/1 |
| 2012/0178655 | A1* | 7/2012 | Jones | C10M 163/00 508/175 |

FOREIGN PATENT DOCUMENTS

| | | | |
|---|---|---|---|
| CA | 2390229 | A1 | 5/2001 |
| JP | 11286696 | A | 10/1999 |
| JP | 2003514099 | A | 4/2003 |
| JP | 2004262979 | A | 9/2004 |
| JP | 2010037421 | A | 2/2010 |
| WO | 2004074414 | A1 | 9/2004 |
| WO | 2009125551 | A1 | 10/2009 |

OTHER PUBLICATIONS

International Search Report issued Feb. 10, 2014 in International Application No. PCT/JP2013/081112.

* cited by examiner

*Primary Examiner* — Cephia D Toomer
(74) *Attorney, Agent, or Firm* — Panitch Schwarze Belisario & Nadel LLP

(57) ABSTRACT

A lubricating oil composition for transmissions having improved fuel saving properties, excellent metal fatigue prevention properties, and heat resistance containing: a lubricating base oil containing (A) a mineral base oil having a 100° C. kinematic viscosity of 1.5 $mm^2/s$ or higher and 3.5 $mm^2/s$ or lower, a pour point of −25° C. or lower, a viscosity index of 105 or greater, a % $C_P$ of 85 or greater, a % $C_N$ of 2 or greater and 20 or less and a % $C_A$ of 3 or less and (B) a monoester-based base oil having a 100° C. kinematic viscosity of 2 to 10 $mm^2/s$; (C) a phosphorus acid ester; and (D) a boronated ashless dispersant, the ratio of the mass percent of boron to the mass percent of phosphorus in the composition (B/P) being from 0.07 to 0.42, and the composition having a 100° C. kinematic viscosity of 2.5 to 4.0 $mm^2/s$ is described.

2 Claims, No Drawings

LUBRICATING OIL COMPOSITION FOR TRANSMISSIONS

CROSS-REFERENCE TO RELATED APPLICATION

This application is a Section 371 of International Application No. PCT/JP2013/081112, filed Nov. 19, 2013, which was published in the Japanese language on Aug. 28, 2014, under International Publication No. WO 2014/129032 A1, and the disclosure of which is incorporated herein by reference.

TECHNICAL FIELD

The present invention relates to lubricating oil compositions, more specifically to a lubricating oil composition having excellent fuel saving properties due to its excellent viscosity temperature characteristics, and also metal fatigue prevention properties and anti-wear/anti-seizure properties despite of its low viscosity, and in particular to a lubricating oil composition for transmissions suitable for automatic transmissions and/or continuously variable transmissions.

BACKGROUND ART

Conventionally, lubricating oils used for automatic transmissions, manual transmissions or internal combustion engines have been required to be enhanced in various durability-related properties such as thermal oxidation stability, anti-wear properties, anti-fatigue properties or the like and to be improved in viscosity temperature characteristics so as to improve the fuel saving properties and in low temperature viscosity characteristics such as reduction in low temperature viscosity and improvement in low temperature fluidity. In order to improve these properties, a lubricating oil has been used, whose base oil is appropriately blended with various additives such as an antioxidant, a detergent dispersant, an antiwear agent, a friction modifier, a seal swelling agents, a viscosity index improver, an anti-foaming agents, a colorant and the like.

Recent transmissions and engines have been demanded to be fuel efficient, small and light and be increased in power output. Transmissions have been sought to be improved in power transmission capability in connection with the increased power output of the engines with which the transmissions are used in combination. Lubricating oils to be used for such transmissions have been, therefore, demanded to maintain high lubricity and to possess properties to prevent the wear or fatigue of surfaces of bearings and gears while reduced in the product viscosity and base oil viscosity as well as anti-seizure properties. Generally, in order to improve the fuel saving properties of a lubricating oil, a technique has been employed, wherein the viscosity temperature characteristics are improved by reducing the base oil viscosity and increasing the amount of a viscosity index improver. However, the reduction in the base oil viscosity degrades the anti-fatigue properties. Therefore, the development of a lubricating oil has been eagerly desired, which can achieve not only good fuel saving properties but also anti-wear/anti-seizure properties and anti-fatigue properties.

Under these circumstances, it has been known to use a base oil with good low temperature properties or a base oil with a high viscosity in combination, or to blend a phosphorus- or sulfur-based extreme pressure additive in a suitable amount in order to improve not only the fuel saving properties but also the low temperature viscosity characteristics and anti-fatigue properties (see, for example, patent documents 1 to 3 below).

However, the techniques disclosed in these patent documents are not sufficient to improve the viscosity temperature characteristics, and low temperature properties as well as anti-fatigue properties and anti-seizure properties. A lubricating oil composition has been, therefore, demanded to be developed, which has all of these properties and characteristics but having no problem in other properties.

CITATION LIST

Patent Literature

Patent Literature 1: Japanese Patent Application Laid-Open Publication No. 2004-262979

Patent Literature 2: Japanese Patent Application Laid-Open Publication No. 11-286696

Patent Literature 3: Japanese Patent Application Laid-Open Publication No. 2003-514099

SUMMARY OF INVENTION

Technical Problem

In view of these current situations, the present invention has an object to provide a lubricating oil composition for transmissions that has excellent fuel saving properties as well as excellent anti-fatigue properties and anti-wear/anti-seizure properties, particularly suitable for automatic transmissions and/or continuously variable transmissions.

Solution to Problem

As the result of the extensive researches and studies carried out by the inventors of the present invention, the present invention has been accomplished on the basis of the finding that a lubricating oil composition comprising a specific base oil and specific additives were excellent in fuel saving properties and anti-wear/anti-seizure properties and able to improve metal fatigue life.

That is, the present invention provides a lubricating oil composition for transmissions comprising: a lubricating base oil comprising (A) a mineral base oil having a 100° C. kinematic viscosity of 1.5 $mm^2/s$ or higher and 3.5 $mm^2/s$ or lower, a pour point of −25° C. or lower, a viscosity index of 105 or greater, a % $C_P$ of 85 or greater, a % $C_N$ of 2 or greater and 20 or less and a % $C_A$ of 3 or less in an amount of 50 to 97 percent by mass on the total base oil composition mass basis and (B) a monoester-based base oil having a 100° C. kinematic viscosity of 2 to 10 $mm^2/s$ in an amount of 3 to 10 percent by mass on the total base oil composition mass basis; (C) a phosphorus acid ester in such an amount that the phosphorus content of the composition is from 250 to 350 ppm by mass on the phosphorus basis; and (D) a boronated ashless dispersant in an amount of 30 to 120 ppm by mass on the boron basis on the total lubricating oil composition mass basis, the ratio of the mass percent of boron to the mass percent of phosphorus in the composition (B/P) being from 0.07 to 0.42 and the composition having a 100° C. kinematic viscosity of 2.5 to 4.0 $mm^2/s$.

The present invention also provides the foregoing lubricating oil composition for transmissions further comprising (E) a polysulfide and/or a thiadiazole.

Advantageous Effect of Invention

The lubricating oil composition of the present invention has excellent viscosity temperature characteristics and antiwear/anti-seizure properties and are superior in metal fatigue prevention properties. The lubricating oil composition of the present invention is, therefore, suitable for automatic transmissions and/or continuously variable transmissions of automobiles, construction machines, agricultural machines and the like.

DESCRIPTION OF EMBODIMENTS

The present invention will be described in detail.

The transmission lubricating oil composition of the present invention (hereinafter may be referred to as "the lubricating oil composition of the present invention") comprises Component (A) which is a mineral base oil having a 100° C. kinematic viscosity of 1.5 $mm^2/s$ or higher and 3.5 $mm^2/s$ or lower.

Component (A) has a 100° C. kinematic viscosity of preferably 2 $mm^2/s$ or higher, more preferably 2.5 $mm^2/s$ or higher, more preferably 2.7 $mm^2/s$ or higher and preferably 3.3 $mm^2/s$ or lower, more preferably 3.1 $mm^2/s$ or lower.

If the 100° C. kinematic viscosity of Component (A) exceeds 3.5 $mm^2/s$, the resulting composition would be degraded in viscosity temperature characteristics and low temperature viscosity characteristics. Whilst, if the 100° C. kinematic viscosity is lower than 1.5 $mm^2/s$, the resulting composition would be poor in metal fatigue prevention properties and heat resistance due to insufficient oil film formation at lubricating sites and would be large in evaporative loss of the lubricating base oil.

The mineral base oil (A) used in the present invention has a viscosity index of 105 or greater, preferably 110 or greater, more preferably 120 or greater, most preferably 125 or greater and preferably 160 or less, more preferably 150 or less, more preferably 140 or less, particularly preferably 135 or less, most preferably 130 or less. If the viscosity index is lower than 110, the resulting composition could not obtain such viscosity temperature characteristics that it can exhibit fuel saving properties. If the viscosity index exceeds 160, the amount of n-paraffin in the lubricating base oil would increase and thus the resulting composition would be rapidly increased in viscosity at low temperatures and loose functions as a lubricating oil.

Component (A) has a pour point of −25° C. or lower, preferably −27.5° C. or lower, more preferably −30° C. or lower, more preferably −35° C. or lower, most preferably −40° C. or lower. No particular limitation is imposed on the lower limit, which is, however, preferably −50° C. or greater because if it is too low, the viscosity index would be decreased and in view of economic efficiency in a dewaxing process. A lubricating oil composition with excellent low temperature viscosity characteristics can be produced by adjusting the pour point of Component (A) to −25° C. or lower. If the pour point is lowered to below −50° C., the resulting composition would not obtain a sufficient viscosity index.

Although either solvent dewaxing or catalytic dewaxing may be used as the dewaxing process, catalytic dewaxing is preferable with the objective of further improving the low temperature viscosity characteristics.

The % $C_P$ of Component (A) is preferably 85 or greater, more preferably 90 or greater with the objective of further enhancing the thermal/oxidation stability and viscosity temperature characteristics.

The % $C_A$ of Component (A) is preferably 3 or less, more preferably 2 or less, more preferably 1 or less. If the % $C_A$ exceeds 3, the resulting composition would be degraded in thermal/oxidation stability.

The % $C_N$ of Component (A) is preferably 20 or less, more preferably 15 or less, more preferably 10 or less and preferably 2 or greater, more preferably 3 or greater, more preferably 5 or greater, particularly preferably 7 or greater with the objective of further extending metal fatigue life.

The flash point of the lubricating base oil used the present invention is preferably 175° C. or higher, more preferably 180° C. or higher, more preferably 185° C. or higher, particularly preferably 190° C. or higher. If the flash point is lower than 175° C., it would cause a trouble in safety in use at high temperatures.

The flash point referred in the present invention means the flash point measured in accordance with JIS K 2265 (open-cup flash point).

No particular limitation is imposed on the aniline point of Component (A), which is, however, preferably 90° C. or higher, more preferably 95° C. or higher, more preferably 100° C. or higher, particularly preferably 103° C. or higher because a lubricating oil composition with excellent low temperature viscosity characteristics and fatigue life can be produced. No particular limitation is imposed on the upper limit of the aniline point, which may, therefore, exceed 130° C. as one aspect but is preferably 130° C. or lower, more preferably 120° C. or lower, more preferably 110° C. or lower because Component (A) would be more excellent in solubility of additives or sludge and compatibility to sealing materials.

No particular limitation is imposed on the sulfur content of Component (A), which is, however, preferably 0.1 percent by mass or less, more preferably 0.05 percent by mass or less, more preferably 0.01 percent by mass or less. Most preferably, sulfur is not substantially contained.

No particular limitation is imposed on the nitrogen content of Component (A). However, nitrogen is contained in an amount of preferably 5 ppm by mass or less, more preferably 3 ppm by mass or less, desirously is not substantially contained with the objective of producing a composition with excellent thermal/oxidation stability.

The sulfur content and nitrogen content referred in the present invention denote the values measured in accordance with ASTM D4951.

No particular limitation is imposed on the method of producing Component (A) as long as it has the above-described properties. However, specific examples of the lubricating base oil used in the present invention include those produced by subjecting a feedstock selected from the following base oils (1) to (8) and/or a lubricating oil fraction recovered therefrom to a given refining process and recovering the lubricating oil fraction:

(1) a distillate oil produced by atmospheric distillation of a paraffin-base crude oil and/or a mixed-base crude oil;

(2) a whole vacuum gas oil (WVGO) produced by vacuum distillation of the topped crude of a paraffin-base crude oil and/or a mixed-base crude oil;

(3) a wax produced by dewaxing of lubricating oil (slack wax) and/or a synthetic wax produced through a gas to liquid (GTL) process (Fischer-Tropsch wax, GTL wax);

(4) a mixed oil of one or more types selected from base oils (1) to (3) and/or an oil produced by mild-hydrocracking the mixed oil;

(5) a mixed oil of two or more types selected from base oils (1) to (4);

(6) a deasphalted oil produced by deasphalting base oil (1), (2) (3), (4) or (5);

(7) an oil produced by hydrocracking base oil (6); and (8) a mixed oil of two or more types selected from base oils (1) to (7).

The above-mentioned given refining process is preferably hydrorefining such as hydrocracking or hydrofinishing, solvent refining such as furfural extraction, dewaxing such as solvent dewaxing and catalytic dewaxing, clay refining with acidic clay or active clay, or chemical (acid or alkali) refining such as sulfuric acid treatment and sodium hydroxide treatment. In the present invention, any one or more of these refining processes may be used in any combination and any order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or

(10) a hydroisomerized mineral oil produced by hydroisomerizing a base oil selected from base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

When lubricating base oil (9) or (10) is produced, the dewaxing process includes preferably catalytic dewaxing with the objective of further enhancing the thermal/oxidation stability and low temperature viscosity characteristics and also anti-fatigue properties of the resulting lubricating oil composition.

If necessary, a solvent refining process and/or a hydrofinishing process may be carried out at appropriate timing upon production of lubricating base oil (9) or (10).

When catalytic dewaxing (catalyst dewaxing) is carried out, a hydrocracked/hydroisomerized oil is reacted with hydrogen in the presence of an appropriate dewaxing catalyst under effective conditions to decrease the pour point. In the catalytic dewaxing, part of a high boiling point substance in the cracked/isomerized product is converted to a low boiling point substance and the low boiling point substance is separated from a heavier base oil fraction to distillate base oil fractions thereby producing two or more types of lubricating base oils. Separation of the low boiling point substance may be carried out prior to produce the intended lubricating base oil or during distillation.

Component (A) may be one type of mineral oil or a mixture of two or more types of mineral oils but is preferably one type of mineral oil so as to suppress the evaporativity and also suppress the flash point from decreasing.

The content of Component (A) in the base oil composition used in the present invention is 50 to 97 percent by mass, preferably 55 percent by mass or more, more preferably 60 percent by mass or more, more preferably 70 percent by mass or more, particularly preferably 80 percent by mass or more. If the content of Component (A) in the base oil composition is less than 50 percent by mass, the resulting lubricating oil composition would be poor in metal fatigue prevention properties and heat resistance.

In addition to Component (A), the lubricating oil composition of the present invention comprises Component (B) as a lubricating base oil that is a monoester-based base oil having a 100° C. kinematic viscosity of 2 to 10 $mm^2/s$.

Component (B) has a 100° C. kinematic viscosity of necessarily 2 to 10 $mm^2/s$, preferably 2.5 $mm^2/s$ or higher. The upper limit is preferably 8 $mm^2/s$ or lower, more preferably 6 $mm^2/s$ or lower, more preferably 5 $mm^2/s$ or lower, particularly preferably 4 $mm^2/s$ or lower, most preferably 3 $mm^2/s$ or lower. If the 100° C. kinematic viscosity of Component (B) exceeds 10 $mm^2/s$, the resulting lubricating oil composition would be poor in viscosity temperature properties and low temperature viscosity characteristics. Whilst, the 100° C. kinematic viscosity is lower than 2 $mm^2/s$, the resulting lubricating oil composition would be poor in metal fatigue prevention properties and load bearing properties due to insufficient oil film formation at lubricating sites and would be large in evaporative loss of the lubricating base oil.

No particular limitation is imposed on the viscosity index of Component (B), but the lower limit is preferably 100 or greater, more preferably 120 or greater, more preferably 140 or greater, more preferably 160 or greater, particularly preferably 170 or greater, most preferably 180 or greater. As one aspect of the present invention, the viscosity index may be 220 or greater but is preferably 220 or less, more preferably 210 or less, more preferably 200 or less, particularly preferably 190 or less in view of excellent solubility with Component (A). The use of Component (B) having a viscosity index of 100 or greater renders it possible to produce a lubricating oil composition having excellent viscosity temperature properties and low temperature viscosity characteristics.

The monoester-based base oil as Component (B) is a base oil comprising an ester of a monohydric alcohol and a monobasic acid.

The monohydric alcohol may be any of those having 1 to 24, preferably 1 to 12, more preferably 1 to 8 carbon atoms, and such alcohols may be of straight-chain or branched and saturated or unsaturated. Specific examples of the alcohols having 1 to 24 carbon atoms include methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

The monobasic acid to be used in the present invention is a fatty acid having 2 to 24 carbon atoms, which may be of straight-chain or branched and saturated or unsaturated. Specific examples of the monobasic acid include saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid, and straight-chain or branched tetracosanoic acid; unsaturated fatty acids, such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid, and straight-chain or branched tetracosenoic acid; and mixtures thereof. Among these monobasic acids, preferred are saturated fatty acids having 3 to 20 carbon atoms, unsaturated fatty acids having 3 to 22 carbon atoms, and mixtures thereof because they can enhance lubricity and treatability. More preferred are saturated fatty acids having 4 to 18 carbon atoms, unsaturated fatty acids having 4 to 18 carbon atoms, and mixtures thereof. In view of oxidation stability, preferred are saturated fatty acids having 4 to 18 carbon atoms.

The monoester-based base oil used as Component (B) in the present invention may be composed of only one type of the above esterified compounds or a mixture of two or more types of these compounds.

No particular limitation is imposed on the density of Component (B), which is, however, preferably 0.80 g/cm$^3$ or higher, more preferably 0.82 g/cm$^3$ or higher, more preferably 0.84 g/cm$^3$ or higher, particularly preferably 0.85 g/cm$^3$ or higher, most preferably 0.86 g/cm$^3$ or higher. No particular limitation is imposed on the upper limit. As one aspect of the present invention, the upper limit may be 1.0 g/cm$^3$ or higher but is preferably 1.0 g/cm$^3$ or lower, more preferably 0.95 g/cm$^3$ or lower, more preferably 0.92 g/cm$^3$ or lower, particularly preferably 0.90 g/cm$^3$ or lower in view of excellent solubility with Component (A). The use of Component (B) having a density of 0.80 g/cm$^3$ or higher renders it possible to achieve all viscosity temperature properties and low temperature properties and anti-wear properties and anti-fatigue properties at a higher level. If the density of Component (B) is lower than 0.80 g/cm$^3$, the resulting lubricating oil composition would be poor in metal fatigue prevention properties and load bearing properties due to insufficient oil film formation at lubricating sites.

With regard to the acid value of Component (B), no particular limitation is imposed on the upper limit thereof, which is, however, preferably 5 mgKOH or lower, more preferably 3 mgKOH or lower, more preferably 2 mgKOH or lower, particularly preferably 1.5 mgKOH or lower, most preferably 1.0 mgKOH or lower. As one aspect of the present invention, the acid value may be 0.2 mgKOH or lower but is preferably 0.2 mgKOH or higher, more preferably 0.5 mgKOH or higher in view of production economic efficiency. The use of Component (B) having an acid value of 5 mgKOH or lower renders it possible to produce a lubricating oil composition having excellent oxidation stability.

The content of Component (B) in the lubricating oil composition of the present invention is necessarily 3 to 10 percent by mass, preferably 4 percent by mass or more, 7 percent by mass or less on the basis of the total mass of the lubricating base oil. The use of Component (B) in an amount of 10 percent by mass or less enhance the oxidation stability and metal fatigue prevention properties of the resulting lubricating oil composition. If the content of Component (B) is less than 3 percent by mass, viscosity temperature properties, low temperature viscosity characteristics and anti-fatigue properties as required may not be obtained.

As long as Component (A) and Component (B) are used as main components in the lubricating oil composition of the present invention, mineral base oils and/or synthetic base oils generally used for a lubricating oil (other than Components (A) and (B)) may be used in combination with Components (A) and (B).

Examples of such mineral base oils include those other than Component (A). Specific examples of such synthetic base oils include polybutenes and hydrogenated compounds thereof; poly-α-olefins such as 1-octene oligomer, 1-decene oligomer and 1-dodecene oligomer or hydrogenated compounds thereof; aromatic synthetic oils such as alkylnaphthalenes and alkylbenzenes; and mixtures thereof.

Among these synthetic oils, preferred are poly-α-olefins such as 1-octene oligomers, 1-decene oligomer and 1-dodecene oligomers and hydrogenated compounds thereof.

When other base oils than Components (A) and (B) are mixed as lubricating base oils therewith in the present invention, the content of the other base oils is 0 to 47 percent by mass, preferably 40 percent by mass or less, more preferably 30 percent by mass or less, more preferably 20 percent by mass or less, particularly preferably 10 percent by mass or less, most preferably 0 percent by mass on the basis of the total mass of the lubricating base oil.

The lubricating base oil used in the present invention is a mixed base oil of Component (A) and Component (B) or a base oil comprising such a mixed base oil and further the above-described mineral base oil and/or synthetic base oil. A mix base oil of Component (A) and Component (B) has a 40° C. kinematic viscosity of preferably 18 mm$^2$/s or lower, more preferably 16 mm$^2$/s or lower, more preferably 14 mm$^2$/s or lower, particularly preferably 12 mm$^2$/s or lower, most preferably 10 mm$^2$/s or lower. The mix base oil has a 40° C. kinematic viscosity of preferably 3 mm$^2$/s or higher, more preferably 5 mm$^2$/s or higher, more preferably 7 mm$^2$/s or higher, particularly preferably 8 mm$^2$/s or higher.

When the lubricating base oil used in the present invention is a base oil comprising the mix base oil of Component (A) and Component (B) and further other mineral base oil and/or synthetic base oil, the lubricating base oil has a 40° C. kinematic viscosity of preferably 18 mm$^2$/s or lower.

No particular limitation is imposed on the 100° C. kinematic viscosity of a mix base oil of Components (A) and (B), which is, however, preferably 3.5 mm$^2$/s or lower, more preferably 3.2 mm$^2$/s or lower, more preferably 3.0 mm$^2$/s or lower, particularly preferably 2.9 mm$^2$/s or lower, most preferably 2.8 mm$^2$/s or lower. The 100° C. kinematic viscosity of the mix base oil is preferably 2 mm$^2$/s or higher, more preferably 2.2 mm$^2$/s or higher, more preferably 2.3 mm$^2$/s or higher, particularly preferably 2.5 mm$^2$/s or higher. The viscosity index of the mix base oil is preferably 100 or greater, more preferably 105 or greater, more preferably 110 or greater, particularly preferably 115 or greater, most preferably 120 or greater.

Component (C) of the lubricating oil composition of the present invention is a phosphorus acid ester.

Examples of Component (C) that is a phosphorus acid ester include (C1) a sulfur-free phosphorus acid ester and/or (C2) a sulfur-containing phosphorus acid ester.

The sulfur-free phosphorus acid ester (C1) is represented by formula $P(OR)_3$ and specifically includes phosphorus acid monoesters, phosphorus acid diesters, phosphorus acid triesters. In this formula, R is hydrogen or a hydrocarbon group having 2 to 30, preferably 3 to 20 carbon atoms, and at least one of Rs is a hydrocarbon group.

Examples of the hydrocarbon group having 2 to 30 carbon atoms include alkyl, cycloalkyl, alkylcycloalkyl, alkenyl, aryl, alkylaryl and arylalkyl groups.

Specific examples of the alkyl group include ethyl, n-propyl, isopropyl, n-butyl, isobutyl, sec-butyl, tert-butyl, various pentyl, various hexyl, various heptyl, various octyl, various nonyl, various decyl, and various dodecyl groups. Example of the cycloalkyl includes cyclohexyl group.

Examples of the alkenyl group include those, which may be straight-chain or branched and the position of which the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups.

Examples of the aryl group include those such as phenyl and naphthyl groups.

Examples of the arylalkyl group include those of which the alkyl groups may be straight-chain or branched, having 7 to 12 carbon atoms, such as benzyl, phenylethyl, phenylpropyl, phenylbutyl, phenylpentyl and phenylhexyl groups.

Specific examples of preferable compounds as Component (C1) include monoalkyl phosphites such as monopropyl phosphite, monobutyl phosphite, monopentyl phosphite, monohexyl phosphite, monoheptyl phosphite, and monooctyl phosphite, of which the alkyl groups may be straight-chain or branched; mono(alkyl)aryl phosphites such as monophenyl phosphite and monocresyl phosphite; dialkyl phosphites such as dipropyl phosphite, dibutyl phosphite, dipentyl phosphite, dihexyl phosphite, diheptyl phosphite, and dioctyl phosphite, of which the alkyl groups may be straight-chain or branched; di(alkyl)aryl phosphites such as diphenyl phosphite and dicresyl phosphite; trialkyl phosphites such as tripropyl phosphite, tributyl phosphite, tripentyl phosphite, trihexyl phosphite, triheptyl phosphite, and trioctyl phosphite, of which the alkyl groups may be straight-chain or branched; tri(alkyl)aryl phosphites such as triphenyl phosphite and tricresyl phosphite; and mixtures thereof.

Among these compounds, preferred are di alkyl phosphites, and particularly preferred is dibutylphosphite.

Examples of (C2) the sulfur-containing phosphorus acid ester include thiophosphorus acid monoesters, thiophosphorus acid diesters and thiophosphorus acid triesters represented by formula (1) below:

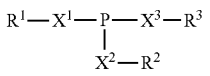

$$R^1—X^1—\underset{\underset{X^2—R^2}{|}}{P}—X^3—R^3 \quad (1)$$

In formula (1), $X^1$, $X^2$ and $X^3$ are each independently oxygen or sulfur, at least one of them is sulfur, and preferably all of them are sulfur. $R^1$, $R^2$ and $R^3$ are each independently hydrogen or a hydrocarbon group having 2 to 30, preferably 3 to 20 carbon atoms. The hydrocarbon group may contain sulfur. Preferably, at least one of $R^1$, $R^2$ and $R^3$ is hydrogen. When any of $R^1$, $R^2$ and $R^3$ is a hydrocarbon group, it is preferably an alkyl group having 4 to 8 carbon atoms, particularly preferably an alkyl group containing sulfur in its main chain. Whereby, the resulting lubricating oil composition can be enhanced in anti-wear properties and metal fatigue durability. When $R^1$ to $R^3$ are hydrocarbon groups, they are preferably different in carbon number from each other. The average of the carbon numbers are preferably within the above-described range. Whereby, the resulting lubricating oil composition can be enhanced in anti-wear properties and metal fatigue durability.

Examples of the hydrocarbon group having 2 to 30 carbon atoms include those described above with respect to R for Component (C1).

Specific examples of preferable compounds as Component (C2) include trialkyltrithiophosphites of which the alkyl groups may be straight-chain or branched, such as tripropyltrithiophosphite, tributyltrithiophosphite, tripentyltrithiophosphite, trihexyltrithiophosphite, triheptyltrithiophosphite, trioctyltrithiophosphite, and trilauryltrithiophosphite; tri((alkyl)aryl)trithiophosphites such as triphenyltrithiophosphite and tircresyltrithiophosphite; and mixtures thereof.

The content of Component (C) in the lubricating oil composition of the present invention is 250 ppm by mass or more, preferably 270 ppm by mass or more on the phosphorus basis on the basis of the total mass of the lubricating oil composition to impart excellent extreme pressure properties and fatigue life. The content is also 350 ppm by mass or less, preferably 320 ppm by mass or less, particularly preferably 310 ppm by mass or less. Component (C) contained in an amount of less than 250 ppm by mass on the phosphorus basis would be less effective to extreme pressure properties or fatigue life. Whilst, Component (C) contained in an amount of more than 350 ppm by mass would deteriorate the oxidation stability of the resulting composition and the durability of resin materials such as nylon, and would negatively affect the fatigue life.

Component (D) of the lubricating oil composition of the present invention is a boronated ashless dispersant.

Examples of the boronated ashless dispersant include nitrogen-containing compounds having per their molecules at least one straight-chain or branched alkyl or alkenyl group having 40 to 400 carbon atoms and derivatives thereof and boronated products of alkenylsuccinicimides. Any one or more types selected from these ashless dispersants may be blended in the lubricating oil composition of the present invention.

Component (D) may be any boronated ashless dispersant that has been conventionally used in lubricating oil but is preferably boronated succinimide because of the excellent detergency thereof.

The carbon number of the alkyl or alkenyl group of the alkenylsuccinimide is preferably 40 to 400, more preferably 60 to 350. If the carbon number of the alkyl or alkenyl group is fewer than 40, the ashless dispersant would tend to be degraded in solubility in the lubricating base oil. Whereas, if the carbon number of the alkyl or alkenyl group is more than 400, the resulting lubricating oil composition would be degraded in low-temperature fluidity. The alkyl or alkenyl group may be straight-chain or branched but is preferably a branched alkyl or alkenyl group derived from oligomers of olefins such as propylene, 1-butene or isobutylene or a cooligomer of ethylene and propylene.

Particularly preferred are succinimides having an alkyl or alkenyl group of a polymer such as 1-butene, isobutylene or the like. The molecular weight of the alkyl or alkenyl group is preferably 1000 or greater, more preferably 1500 or greater and 3000 or less. If the molecular weight is less than 1000, the resulting composition would be deteriorated in friction characteristic for a wet clutch. If the molecular weight exceeds 3000, the resulting composition would be deteriorated in low temperature viscosity.

The lubricating oil composition for transmissions of the present invention may comprise either of a mono-type or bis-type succinimide or both types of succinimides.

No particular limitation is imposed on the method of producing these succinimides. For example, a method may be used, wherein an alkyl or alkenyl succinimide produced by reacting a compound having an alkyl or alkenyl group having 40 to 400 carbon atoms with maleic anhydride at a temperature of 100 to 200° C. is reacted with a polyamine. Examples of the polyamine include diethylene triamine, triethylene tetramine, tetraethylene pentamine, and pentaethylene hexamine.

In the lubricating oil composition of the present invention, the boron content on the boron basis derived from the boronated succinimide component is necessarily 30 ppm by mass or more and 120 ppm by mass or less on the total composition mass basis with the objective of enhancing both fatigue life and extreme pressure properties. The boron content is preferably 35 ppm by mass or more and preferably 100 percent by mass ppm or less, more preferably 75 ppm by mass or less, most preferably 60 ppm by mass or less. The boronated succinimide contained in an amount of less than 30 ppm by mass would be insufficiently effective while the boronated succinimide contained in an amount of more than 120 ppm by mass would be degraded in properties.

The ratio of the boron content of the succinimide in percent by mass on the boron basis to the phosphorus content of the phosphorus-containing additive in the composition in percent by mass on the phosphorus basis (ratio (B/P) of the percent by mass on the boron basis to the percent by mass on the phosphorus basis) is necessarily 0.07 to 0.42. The B/P is preferably 0.09 or greater, more preferably 0.12 or greater. The B/P is also preferably 0.35 or less, more preferably 0.25 or less, most preferably 0.2 or less. If the B/P is less than 0.07, the resulting composition would be poor in fatigue life and less effective. If the B/P exceed 0.42, it would be difficult to enhance fatigue life and extreme pressure properties in a well-balanced manner.

Preferably, the lubricating oil composition of the present invention further comprises a polysulfide and/or a thiadiazole as Component (E).

Examples of the polysulfide include sulfurized fats and oils, sulfurized olefins and dihydrocarbyl polysulfides.

Examples of the sulfurized fats and oils include oils such as sulfurized lard, sulfurized rapeseed oil, sulfurized ricinus oil, sulfurized soybean oil, and sulfurized rice bran oil; desulfurized fatty acids such as sulfurized oleic acid; and sulfurized esters such as sulfurized oleic methyl oleate.

Examples of the sulfurized olefin include compounds represented by formula (2):

$$R^1—Sx-R^2 \quad (2).$$

In formula (2), $R^1$ is an alkenyl group having 2 to 15 carbon atoms, $R^2$ is an alkyl or alkenyl group having 2 to 15 carbon atoms, and x is an integer of 1 to 8, preferably 2 or greater, particularly preferably 4 or greater.

The compounds can be produced by reacting an olefin having 2 to 15 carbon atoms or a dimer to tetramer thereof with sulfur or a sulfurizing agent such as sulfur chloride.

Such an olefin is preferably propylene, isobutene, or diisobutene.

The dihydrocarbyl polysulfide is a compound represented by formula (3):

$$R^3—Sy-R^4 \quad (3).$$

In formula (3), $R^3$ and $R^4$ are each independently an alkyl (including cycloalkyl) group having 1 to 20 carbon atoms, an aryl group having 6 to 20 carbon atoms, or an arylalkyl or alkylaryl group having 7 to 20 carbon atoms and may be the same or different from each other, and y is an integer of 2 to 8.

Specific examples of $R^3$ and $R^4$ include methyl, ethyl, n-propyl, isopropyl, n-butyl, isobutyl, sec-butyl, tert-butyl, various pentyl, various hexyl, various heptyl, various octyl, various nonyl, various decyl, various dodecyl, cyclohexyl, phenyl, naphthyl, tolyl, xylyl, benzyl, and phenetyl groups.

Preferred examples of the dihydrocarbyl polysulfide include dibenzyl polysulfide, di-tert-nonylpolysulfide, didodecylpolysulfide, di-tert-butylpolysulfide, dioctylpolysulfide, diphenylpolysulfide, and dicyclohexylpolysulfide.

Component (E), i.e., polysulfides used in the present invention are preferably sulfurized olefins, most preferably those represented by formula (2) wherein x is an integer of 4 to 8.

Component (E) used in the present invention is preferably a thiadiazole. No particular limitation is imposed on the structure of the thiadiazole. However, examples of the thiadiazole include 1,3,4-thiadiazole compounds represented by formula (4), 1,2,4-thiadiazole compounds represented by formula (5) and 1,4,5-thidiazole compounds represented by formula (6).

(4)

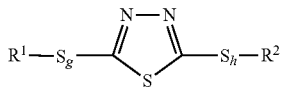

(5)

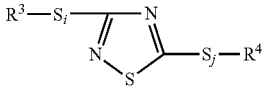

(6)

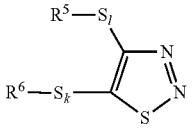

In formula (4) to (6), $R^1$, $R^2$, $R^3$, $R^4$, $R^5$ and $R^6$ may be the same or different from one another and are each independently hydrogen or a hydrocarbon group having 1 to 30 carbon atoms, and g, h, i, j, k and l are each independently an integer of 0 to 8. Examples of the hydrocarbon group having 1 to 30 carbon atoms include alkyl, cycloalkyl, alkylcycloalkyl, alkenyl, aryl, alkylaryl and arylalkyl groups.

The lubricating oil composition of the present invention may contain various additives if necessary to an extent that they would not harm the excellent viscosity temperature properties and low temperature properties, anti-fatigue properties and anti-seizure properties. No particular limitation is imposed on such additives, and thus any additives that have been conventionally used in the field of lubricating oils may be blended in the lubricating oil composition of the present invention. Specific examples of such lubricating oil additives include viscosity index improvers, metallic detergents, ashless dispersants, antioxidants, extreme pressure additives, antiwear agents, friction modifiers, pour point depressants, corrosion inhibitors, rust inhibitors, demulsifiers, metal deactivators, and anti-foaming agents. Any one or a combination of any two of these additives may be used.

The lubricating oil composition of the present invention contain substantially no viscosity index improver. This means that the composition does not contain a viscosity index improver at all or even if it does, contains a viscosity index improver in an extremely smaller amount than a typical amount in which a viscosity index improver is expected to exhibit its effect (2 to 10 percent by mass). Specifically, the viscosity index improver is contained in an amount of preferably 1.0 percent by mass or less, more preferably 0.5 percent by mass or less, and most preferably is not contained at all. If the content of the viscosity index improver exceeds 1.0 percent by mass, it would cause the viscosity to reduce due to shear in use and is not preferable in terms of maintaining the minimum viscosity of a lubricating oil to exhibit fuel saving properties at the maximum.

Examples of the viscosity index improver include non-dispersant type or dispersant type viscosity index improvers. Specific examples of the non-dispersant type viscosity index improver include: homopolymers or copolymers of one or more type of monomer selected from alkylacrylates and alkylmethacrylates having 1 to 30 carbon atoms, olefins having 2 to 20 carbon atoms, styrene, methylstyrene, maleic anhydride ester and maleic anhydride amide; and hydrogenated compounds thereof.

Examples of the dispersant type viscosity index improver include: copolymers of homopolymers or copolymers of one or more monomers selected from dimethyl aminomethylmethacrylate, diethylaminomethylmethacrylate, dimethylaminoethylmethacylate, diethylaminoethylmethacrylate, 2-methyl-5-vinyl pyridine, morpholinomethylmethacrylate, morpholinoethylmethacrylate, N-vinylpyrrolidone, or hydrogenated compounds of the homopolymers or copolymers into which an oxygen-containing group is introduced and monomer components of the non-dispersant type viscosity index improver; and hydrogenated compounds thereof.

Examples of the metallic detergent include sulfonate detergents, salicylate detergents, and phenate detergents. Any of normal salt, basic salt or overbased salts of these detergents with an alkali metal or alkaline earth metal may be blended with the lubricating oil composition of the present invention. In use, any one or more type selected from these ashless dispersants may be blended with the lubricating oil composition of the present invention.

Examples of the anti-oxidant include ashless antioxidants such as phenol-based and amine-based and metallic antioxidants such as copper-based and molybdenum-based.

Examples of the friction modifier include ashless friction modifiers such as those of fatty acid ester-, aliphatic amine- and fatty acid amide-based and metallic friction modifiers such as molybdenum dithiocarbamates and molybdenum dithiophosphates.

As same as for the viscosity index improver, the lubricating oil composition of the present invention preferably contains substantially no pour point depressant. This means that the composition does not contain a pour point depressant at all or contains a pour point depressant in an extremely smaller amount than a typical amount in which a pour point depressant is expected to exhibit its effect (0.01 to 3 percent by mass). Specifically, the pour point depressant is contained in an amount of 0.005 percent by mass or less, preferably 0.001 percent by mass or less on the basis of the total mass of the composition, and most preferably is not contained at all. If the content of the pour point depressant exceeds 0.005 percent by mass, it would cause the viscosity to reduce due to shear in use and is not preferable in terms of maintaining the minimum viscosity of a lubricating oil to exhibit fuel saving properties at the maximum.

Examples of the corrosion inhibitor include benzotriazole-, tolyltriazole- and imidazole-types compounds.

Examples of the rust inhibitor include petroleum sulfonates, alkylbenzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, benzotriazoles and derivatives thereof, 2-(alkyldithio)benzoimidazole, and β-(o-carboxybenzylthio)propionitrile.

Examples of the anti-foaming agent include silicone oil with a 25° C. kinematic viscosity of 0.1 to lower than 100 $mm^2/s$, alkenylsuccinic acid derivatives, esters of polyhydroxyaliphatic alcohols and long-chain fatty acids, methylsalicylate and o-hydroxybenzyl alcohol.

When these additives are contained in the lubricating oil composition the present invention, they are contained in an amount of preferably 0.1 to 20 percent by mass on the total composition mass basis.

The 100° C. kinematic viscosity of the lubricating oil composition of the present invention is necessarily 2.5 to 4.0 $mm^2/s$, preferably 2.7 $mm^2/s$ or higher and 3.3 $mm^2/s$ or lower.

If the 100° C. kinematic viscosity is lower than 2.5 $mm^2/s$, it would cause problems in oil film retainability at lubricating sites and evaporativity. Whilst, if the 100° C. kinematic viscosity exceeds 4.0 $mm^2/s$, the resulting composition would lack in fuel saving properties.

No particular limitation is imposed on the viscosity index of the lubricating oil composition of the present invention, which is, however, preferably 120 or greater, more preferably 140 or greater in view of fuel saving properties.

The −40° C. Brookfield (BF) viscosity of the lubricating oil composition of the present invention is preferably 15000 mPa·s or lower, more preferably 10000 mPa·s or lower, more preferably 8000 mPa·s or lower, particularly preferably 5000 mPa·s or lower, most preferably 4000 mPa·s or lower. If the −40° C. Brookfield (BF) viscosity exceeds 15000 mPa·s, the resulting composition would be high in viscous resistance upon starting the engine and thus cause a degradation in fuel saving properties.

The Brookfield viscosity referred herein denotes the value measured in accordance with ASTM D2983.

The lubricating oil composition of the present invention is a lubricating oil composition having excellent anti-wear properties and anti-fatigue properties and also excellent low temperature fluidity and thus particularly suitable as an automatic transmission oil and/or a continuously variable transmission oil.

Furthermore, the lubricating oil composition of the present invention is also excellent in properties for oils for transmissions other than those described above and thus suitably used as a lubricating oil for automatic transmissions, manual transmissions, differential gears of automobiles, construction machinery, agricultural machines and the like. Furthermore, the lubricating oil composition may be suitably used as a lubricating oil required to have anti-wear properties, anti-fatigue properties, and low temperature viscosity characteristics, such as a gear oil for industrial use, a lubricating oil for the gasoline engines, diesel engines, and gas engines of automobiles such as two- and four-wheeled vehicles, power generators, and ships, a turbine oil, and a compressor oil.

EXAMPLES

Hereinafter, the present invention will be described in more detail by way of the following examples and comparative examples, which should not be construed as limiting the scope of the invention.

Examples 1 to 8 and Comparative Examples 1 to 12

As set forth in Table 1, lubricating oil compositions of the present invention (Examples 1 to 8) and those for comparison (Comparative Examples 1 to 12) were prepared. The kinematic viscosity, viscosity index, low temperature viscosity characteristics, anti-fatigue properties, four-ball anti-seizure properties were measured for each of the resulting compositions. The results are also set forth in Table 1.

(1) Low temperature viscosity characteristics

The −40° C. BF viscosity of each of the lubricating oil compositions was measured in accordance with ASTM D2983. In this test, a lower BF viscosity means that the composition is excellent in low temperature fluidity.

(2) Anti-Fatigue Properties

The fatigue life up to pitting was evaluated for each composition under the following conditions using a high temperature rolling-contact fatigue test machine. The fatigue life was indicated by 10% cumulative failure probability.

In the rolling fatigue tester, a thrust ball bearing (NSK thrust ball bearing 51305, 3 balls were used) was used as a test piece. The test conditions were: contact pressure: 5.9 GPa, revolution number: 1500 rpm, oil temperature: 120° C.

(3) High-Speed Four-Ball Heat Resistance

The last non-seizure load (LNSL) of each of the compositions at a rotating speed of 1800 rpm was measured using a high-speed four-ball tester in accordance with ASTM D 2596. In this test, a larger last non-seizure load indicates that the composition is more excellent in heat resistance.

As apparent from the results set forth in Table 1, the lubricating oil compositions of Examples 1 to 5 according to the present invention are excellent in viscosity temperature properties, low temperature viscosity characteristics, anti-fatigue properties and anti-seizure properties.

TABLE 1

| | | Example 1 | Example 2 | Example 3 | Example 4 | Example 5 | Example 6 | Example 7 | Example 8 |
|---|---|---|---|---|---|---|---|---|---|
| Base oil A-1 | | 95 | 93 | 95 | 95 | 95 | 95 | 70 | 55 |
| Base oil A-2 | mass % | | | | | | | 25 | 40 |
| Base oil A-3 | mass % | | | | | | | | |
| Base oil B-1 | | 5 | 7 | 5 | 5 | 5 | 5 | 5 | 5 |
| Base oil B-2 | | | | | | | | | |
| Base oil kinematic viscosity@100° C. | $mm^2/s$ | 2.8 | 2.8 | 2.8 | 2.8 | 2.8 | 2.8 | 2.8 | 2.8 |
| Base oil viscosity index | | 125 | 125 | 125 | 125 | 125 | 125 | 122 | 119 |
| Ashless dispersant-1 (boron-based) | | 1.0 | 1.0 | 0.75 | 2.5 | 1.0 | 1.0 | 1.0 | 1.0 |
| boron content | mass ppm | 40 | 40 | 30 | 100 | 40 | 40 | 40 | 40 |
| Ashless dispersant-2 (non-boron based) | | 1.5 | 1.5 | 1.75 | 1.0 | 1.5 | 1.5 | 1.5 | 1.5 |
| Phosphorus acid ester | | 0.19 | 0.19 | 0.19 | 0.19 | 0.16 | 0.20 | 0.19 | 0.19 |
| phosphorus content | mass ppm | 302 | 302 | 302 | 302 | 261 | 326 | 302 | 302 |
| Ratio of boron mass % to phosphorus mass % (B/P) | | 0.133 | 0.133 | 0.099 | 0.332 | 0.153 | 0.123 | 0.133 | 0.133 |
| Ca detergent | | 0.1 | 0.1 | 0.1 | 0.1 | 0.1 | 0.1 | 0.1 | 0.1 |
| Antioxidant 1 | | 0.5 | 0.5 | 0.5 | 0.5 | 0.5 | 0.5 | 0.5 | 0.5 |
| Antioxidant 2 | | 0.4 | 0.4 | 0.4 | 0.4 | 0.4 | 0.4 | 0.4 | 0.4 |
| Sulfur-based additive | | 0.15 | 0.15 | 0.15 | 0.15 | 0.15 | 0.15 | 0.15 | 0.15 |
| Sulfur content of sulfur-based additive | % | 0.05 | 0.05 | 0.05 | 0.05 | 0.05 | 0.05 | 0.05 | 0.05 |
| Sulfur content in composition | % | 0.09 | 0.09 | 0.09 | 0.09 | 0.09 | 0.09 | 0.09 | 0.09 |
| Kinematic viscosity @100° C. | $mm^2/s$ | 3.3 | 3.3 | 3.3 | 3.3 | 3.3 | 3.3 | 3.3 | 3.3 |
| Viscosity index | | 145 | 145 | 145 | 145 | 145 | 145 | 141 | 139 |
| Flash point | ° C. | 190 | 190 | 188 | 190 | 190 | 190 | 188 | 184 |
| Pour point | ° C. | <−45 | <−45 | <−45 | <−45 | <−45 | <−45 | <−45 | <−45 |
| BF viscosity@−40° C. | mPa · s | 3500 | 3500 | 3400 | 3500 | 3500 | 3500 | 3800 | 4000 |
| Fatigue life (Unisteel) L10 | min | 368 | 353 | 322 | 325 | 334 | 311 | 348 | 335 |
| Four ball extreme pressure LNSL | N | 618 | 618 | 618 | 618 | 618 | 618 | 618 | 618 |

| | | Comparative Example 1 | Comparative Example 2 | Comparative Example 3 | Comparative Example 4 | Comparative Example 5 | Comparative Example 6 |
|---|---|---|---|---|---|---|---|
| Base oil A-1 | | 95 | 95 | | | 98 | 88 |
| Base oil A-2 | mass % | | | 95 | | | |
| Base oil A-3 | mass % | | | | 95 | | |
| Base oil B-1 | | 5 | 5 | 5 | 5 | 2 | 12 |
| Base oil B-2 | | | | | | | |
| Base oil kinematic viscosity@100° C. | $mm^2/s$ | 2.8 | 2.8 | 2.7 | 2.1 | 2.8 | 2.8 |
| Base oil viscosity index | | 125 | 125 | 112 | 98 | 123 | 133 |
| Ashless dispersant-1 (boron-based) | | 0.5 | 3.8 | 1.0 | 1.0 | 1.0 | 1.0 |
| boron content | mass ppm | 20 | 150 | 40 | 40 | 40 | 40 |
| Ashless dispersant-2 (non-boron based) | | 2.0 | 0.5 | 1.5 | 1.5 | 1.5 | 1.5 |

TABLE 1-continued

| | | | | | | | |
|---|---|---|---|---|---|---|---|
| Phosphorus acid ester | | 0.19 | 0.19 | 0.19 | 0.19 | 0.19 | 0.19 |
| phosphorus content | mass ppm | 302 | 302 | 302 | 302 | 302 | 302 |
| Ratio of boron mass % to phosphorus mass % (B/P) | | 0.066 | 0.497 | 0.133 | 0.133 | 0.133 | 0.133 |
| Ca detergent | | 0.1 | 0.1 | 0.1 | 0.1 | 0.1 | 0.1 |
| Antioxidant 1 | | 0.5 | 0.5 | 0.5 | 0.5 | 0.5 | 0.5 |
| Antioxidant 2 | | 0.4 | 0.4 | 0.4 | 0.4 | 0.4 | 0.4 |
| Sulfur-based additive | | 0.15 | 0.15 | 0.15 | 0.15 | 0.15 | 0.15 |
| Sulfur content of sulfur-based additive | % | 0.05 | 0.05 | 0.05 | 0.05 | 0.05 | 0.05 |
| Sulfur content in composition | % | 0.09 | 0.09 | 0.09 | 0.17 | 0.09 | 0.09 |
| Kinematic viscosity @100° C. | $mm^2/s$ | 3.3 | 3.3 | 3.3 | 2.8 | 3.3 | 3.3 |
| Viscosity index | | 145 | 145 | 127 | 119 | 144 | 158 |
| Flash point | ° C. | 192 | 190 | 174 | 174 | 194 | 188 |
| Pour point | ° C. | <−45 | <−45 | <−45 | <−45 | <−45 | <−45 |
| BF viscosity@−40° C. | mPa · s | 4000 | 3900 | 4200 | 7300 | 4000 | 3700 |
| Fatigue life (Unisteel) L10 | min | 270 | 301 | 298 | 273 | 299 | 296 |
| Four ball extreme pressure LNSL | N | 490 | 618 | 490 | 490 | 618 | 490 |

| | | Comparative Example 7 | Comparative Example 8 | Comparative Example 9 | Comparative Example 10 | Comparative Example 11 | Comparative Example 12 |
|---|---|---|---|---|---|---|---|
| Base oil A-1 | | | | 95 | 95 | 95 | 25 |
| Base oil A-2 | mass % | 100 | | | | | 70 |
| Base oil A-3 | mass % | | 100 | | | | |
| Base oil B-1 | | | | | 5 | 5 | 5 |
| Base oil B-2 | | | | 5 | | | |
| Base oil kinematic viscosity@100° C. | $mm^2/s$ | 2.7 | 2.1 | 2.9 | 2.8 | 2.8 | 2.8 |
| Base oil viscosity index | | 109 | 96 | 126 | 125 | 125 | 114 |
| Ashless dispersant-1 (boron-based) | | 1.0 | 1.0 | 1.0 | 1.0 | 1.0 | 1.0 |
| boron content | mass ppm | 40 | 40 | 40 | 40 | 40 | 40 |
| Ashless dispersant-2 (non-boron based) | | 1.5 | 1.5 | 1.5 | 1.5 | 1.5 | 1.5 |
| Phosphorus acid ester | | 0.19 | 0.19 | 0.19 | 0.14 | 0.23 | 0.19 |
| phosphorus content | mass ppm | 302 | 302 | 302 | 228 | 375 | 302 |
| Ratio of boron mass % to phosphorus mass % (B/P) | | 0.133 | 0.133 | 0.133 | 0.175 | 0.107 | 0.133 |
| Ca detergent | | 0.1 | 0.1 | 0.1 | 0.1 | 0.1 | 0.1 |
| Antioxidant 1 | | 0.5 | 0.5 | 0.5 | 0.5 | 0.5 | 0.5 |
| Antioxidant 2 | | 0.4 | 0.4 | 0.4 | 0.4 | 0.4 | 0.4 |
| Sulfur-based additive | | 0.15 | 0.15 | 0.15 | 0.15 | 0.15 | 0.15 |
| Sulfur content of sulfur-based additive | % | 0.05 | 0.05 | 0.05 | 0.05 | 0.05 | 0.05 |
| Sulfur content in composition | % | 0.09 | 0.17 | 0.09 | 0.09 | 0.09 | 0.09 |
| Kinematic viscosity @100° C. | $mm^2/s$ | 3.3 | 2.8 | 3.3 | 3.3 | 3.3 | 3.3 |
| Viscosity index | | 126 | 118 | 149 | 145 | 145 | 131 |
| Flash point | ° C. | 174 | 176 | 192 | 192 | 190 | 176 |
| Pour point | ° C. | −42.5 | −37.5 | <−45 | <−45 | <−45 | <−45 |
| BF viscosity@−40° C. | mPa · s | 16000 | 100万以上 | 8100 | 4000 | 3900 | 4100 |
| Fatigue life (Unisteel) L10 | min | 153 | 253 | 254 | 270 | 264 | 301 |
| Four ball extreme pressure LNSL | N | 490 | 490 | 618 | 490 | 490 | 490 |

Base oil A-1: mineral oil [100° C. kinematic viscosity: 2.84 $mm^2/s$, 40° C. kinematic viscosity: 10.4 $mm^2/s$, viscosity index: 125, aniline point 114° C., % $C_P$: 92, % $C_N$ 7.8, % $C_A$: O, pour point: −30.0° C., S content: 1 mass ppm or less, N content 3 mass ppm or less, flash point 194° C.]
Base oil A-2: mineral oil [100° C. kinematic viscosity: 2.74 $mm^2/s$, 40° C. kinematic viscosity: 10.2 $mm^2/s$, viscosity index: 109, aniline point 104° C., % $C_P$: 75, % $C_N$ 23, % $C_A$: 1, pour point −27.5° C., S content 1 mass ppm or less, N content 3 mass ppm or less, flash point 176° C.]
Base oil A-3: mineral oil [100° C. kinematic viscosity: 2.08 $mm^2/s$, 40° C. kinematic viscosity: 6.87 $mm^2/s$, viscosity index: 96, aniline point 89° C., % $C_P$: 63, % $C_N$ 31, % $C_A$: 6, pour point −25.0° C., S content 800 mass ppm, N content 20 mass ppm, flash point 168° C.]
Base oil B-1: monoester (monoester of $C_8$ alcohol and fatty acid) [density: 0.87 $g/cm^3$, 100° C. kinematic viscosity: 2.68 $mm^2/s$, 40° C. kinematic viscosity: 8.2 $mm^2/s$, 0° C. kinematic viscosity: 30.8 $mm^2/s$, viscosity index: 182, pour point −40° C., acid value: 1.0 mgKOH]
Base oil B-2: polyolester (neopentylglycol diester) [density: 0.90 $g/cm^3$, 100° C. kinematic viscosity: 5.9 $mm^2/s$, 40° C. kinematic viscosity: 24.0 $mm^2/s$, 0° C. kinematic viscosity: 127 $mm^2/s$, viscosity index: 206, pour point −30° C., acid value: 1.0 mgKOH]
Ashless dispersant-1 succinimide where N 0.7 mass %, B 0.4 mass %, alkenyl group molecular weight 6000
Ashless dispersant-2 succinimide where N 1.5 mass %, alkenyl group molecular weight 2000
Phosphorus acid ester phosphorus acid ester, phosphorus content 16.3 mass %
Ca detergent 0.1 mass % sulfonate detergent wherein calcium content is 10 mass %
Antioxidant 1 amine-based antioxidant, nitrogen content 4 mass %
Antioxidant 2 phenol-based antioxidant
Sulfur-based additive 1,3,4-thiadiazole compound: nitrogen content 7 mass % sulfur content 36%

The invention claimed is:

1. A lubricating oil composition for transmissions comprising:

a lubricating base oil comprising (A) a mineral base oil having a 100° C. kinematic viscosity of 1.5 $mm^2/s$ or higher and 3.5 $mm^2/s$ or lower, a pour point of −25° C. or lower, a viscosity index of 105 or greater, a % $C_P$ of 85 or greater, a % $C_N$ of 2 or greater and 20 or less and a % $C_A$ of 3 or less in an amount of 50 to 97 percent by mass on the total base oil composition mass basis and (B) a monoester-based base oil having a 100° C. kinematic viscosity of 2 to 10 $mm^2/s$ in an amount of 3 to 10 percent by mass on the total base oil composition mass basis;

(C) a phosphorus acid ester in such an amount that the phosphorus content of the composition is from 250 to 350 ppm by mass on the phosphorus basis; and (D) a boronated ashless dispersant in an amount of 30 to 120 ppm by mass on the boron basis on the total lubricating oil composition mass basis, the ratio of the mass percent of boron to the mass percent of phosphorus in the composition (B/P) being from 0.07 to 0.42 and the composition having a 100° C. kinematic viscosity of 2.5 to 4.0 $mm^2/s$.

2. The lubricating oil composition for transmissions according to claim 1 further comprising (E) a polysulfide and/or a thiadiazole.

* * * * *